United States Patent [19]

Wood

[11] Patent Number: 4,974,731

[45] Date of Patent: Dec. 4, 1990

[54] RECLOSABLE CARTON

[75] Inventor: Prentice J. Wood, Hapeville, Ga.

[73] Assignee: The Mead Corporation, Dayton, Ohio

[21] Appl. No.: 496,453

[22] Filed: Mar. 20, 1990

[51] Int. Cl.[5] ..... B65D 5/54

[52] U.S. Cl. ..... 206/607; 206/611; 206/614; 206/626

[58] Field of Search ..... 206/611, 614, 615, 626, 206/607

[56] References Cited

U.S. PATENT DOCUMENTS

| | | | |
|---|---|---|---|
| 3,110,434 | 11/1963 | Linda et al. | 206/626 |
| 3,235,167 | 2/1966 | Svensson | 206/614 |
| 4,498,581 | 2/1985 | Dutcher | 206/615 |
| 4,746,019 | 5/1988 | Prater | 206/607 |

FOREIGN PATENT DOCUMENTS

| | | | |
|---|---|---|---|
| 2104708 | 4/1972 | France | 206/611 |
| 473018 | 9/1937 | United Kingdom | 206/611 |

*Primary Examiner*—Gary E. Elkins

*Attorney, Agent, or Firm*—Rodgers & Rodgers

[57] ABSTRACT

A reclosable carton for packaging a plurality of cans and having interconnected top, bottom and side walls and end closure panels, includes a reclosable opening panel struck from one of the walls and foldably joined thereto along one edge thereof and severable therefrom along other parts of its periphery, a lap panel disposed in flat face contacting relation with a part of the inner surface of the wall from which the reclosing opening panel is struck and disposed in overlapping relation with an edge of the reclosable opening panel along which the reclosable opening panel is severable from the wall, and an edge of the reclosable opening panel being arranged for tucking into engagement with the inner surface of the lap panel so as to reclose the carton.

11 Claims, 5 Drawing Sheets

RECLOSABLE CARTON

TECHNICAL FIELD

This invention relates to can cartons and more particularly to cartons which are reclosable by virtue of a panel struck from one of the carton walls and defining an opening through which cans may be removed and their contents consumed, after which the empty cans are placed in the carton and the opening is reclosed to facilitate the return of empty cans.

BACKGROUND ART

U.S. Pat. No. 2,473,492 for a Reclosable Carton issued June 14, 1949 discloses a carton having a reclosable flap struck from one wall of the carton to define an opening through which cans may be removed and returned to the carton, the reclosable flap being secured in closed position by a finger tab foldably joined to the reclosure flap and arranged to engage a slot disposed to receive a part of the finger tab thereby to reclose the carton.

U.S. Pat. No. 2,864,547 issued Dec. 16, 1958 discloses a Reclosable Carton having a reclosable panel struck from end panels of the carton and which define an opening for removing and reloading cans into the carton, the opening being defined by a pair of closure flaps arranged for disposition in overlapping relation and for an appropriate interlock of the two closure flaps.

SUMMARY OF THE INVENTION

According to this invention in one form, a reclosable carton for packaging a plurality of cans includes interconnected top, bottom and side walls together with end closure panels, a reclosable opening panel struck from one of the walls and foldably joined thereto along an edge of said panel and severable therefrom along other edges thereof, a lap panel disposed in flat face contacting relation with a part of the inner surface of said one wall and in overlapping relation with an edge portion of said reclosable opening panel along which said reclosable opening panel is severable from said one wall, and an edge portion of said reclosable opening panel being arranged to be tucked into engagement with the inner surface of said lap panel so as to secure the reclosable opening panel in carton closing condition.

BEST MODE OF CARRYING OUT THE INVENTION

Figure 2:
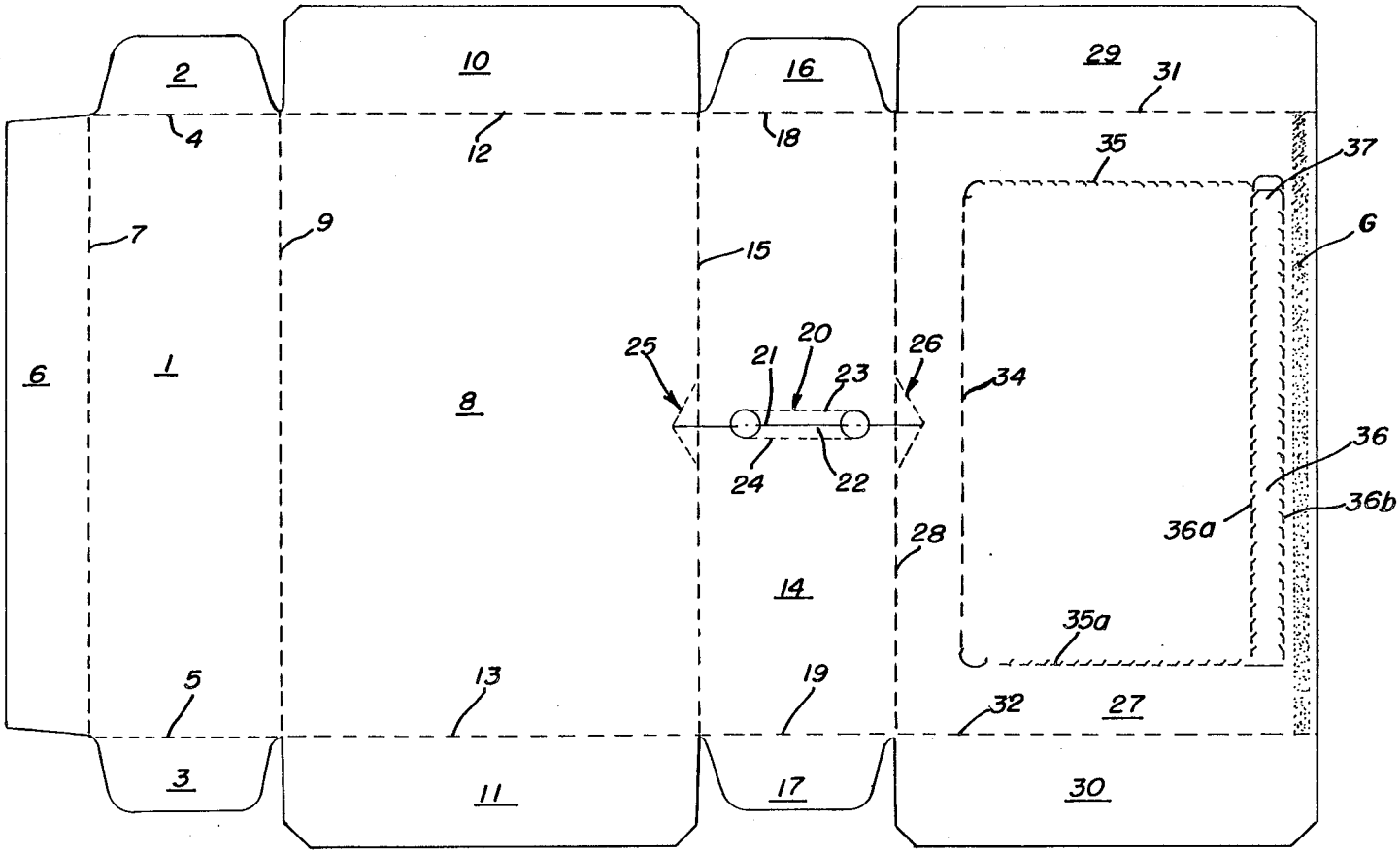
FIG. 2 is a unitary blank as viewed from the inside and from which the carton of FIG. 1 is formed.

With reference primarily to FIG. 2, the numeral 1 designates a wall of the carton to the ends of which end closure panels 2 and 3 are foldably joined along fold lines 4 and 5 respectively. A lap panel 6 is foldably joined to wall panel 1 along fold line 7.

Wall panel 8 is foldably joined to wall 1 along fold line 9 and end closure panels 10 and 11 are foldably joined to the end edges of wall 8 along fold lines 12 and 13 respectively.

Wall 14 is foldably joined to wall 8 along fold line 15 and end closure panels 16 and 17 are foldably joined to the end edges of wall 14 along fold lines 18 and 19 respectively. Handle structure generally designated by the numeral 20 includes a pair of handle flaps 21 and 22 foldably joined to wall 14 along fold lines 23 and 24 respectively. Cut and score lines generally designated at 25 are formed in wall 8 and similar structure designated by the numeral 26 is formed in wall 27 which is foldably joined to wall 14 along fold line 28. The handle structure 20, 25 and 26 is fully disclosed and claimed in U.S. Pat. No. 4,558,816 issued Dec. 17, 1985 and assigned to the assignee of this invention.

End closure panels 29 and 30 are foldably joined to wall panel 27 along fold lines 31 and 32 respectively.

In accordance with a feature of this invention, a reclosable opening panel generally designated by the numeral 33 is struck from wall 27 and is foldably joined thereto along a fold line 34. Opposite edges of reclosable opening panel 33 are defined by tear lines 35 and **35*a* and the fourth edge of reclosable opening panel 33 is defined by one edge 36*a* of tear strip 36 having a pull tab 37 secured to one end of tear strip 36**.

Figure 1:
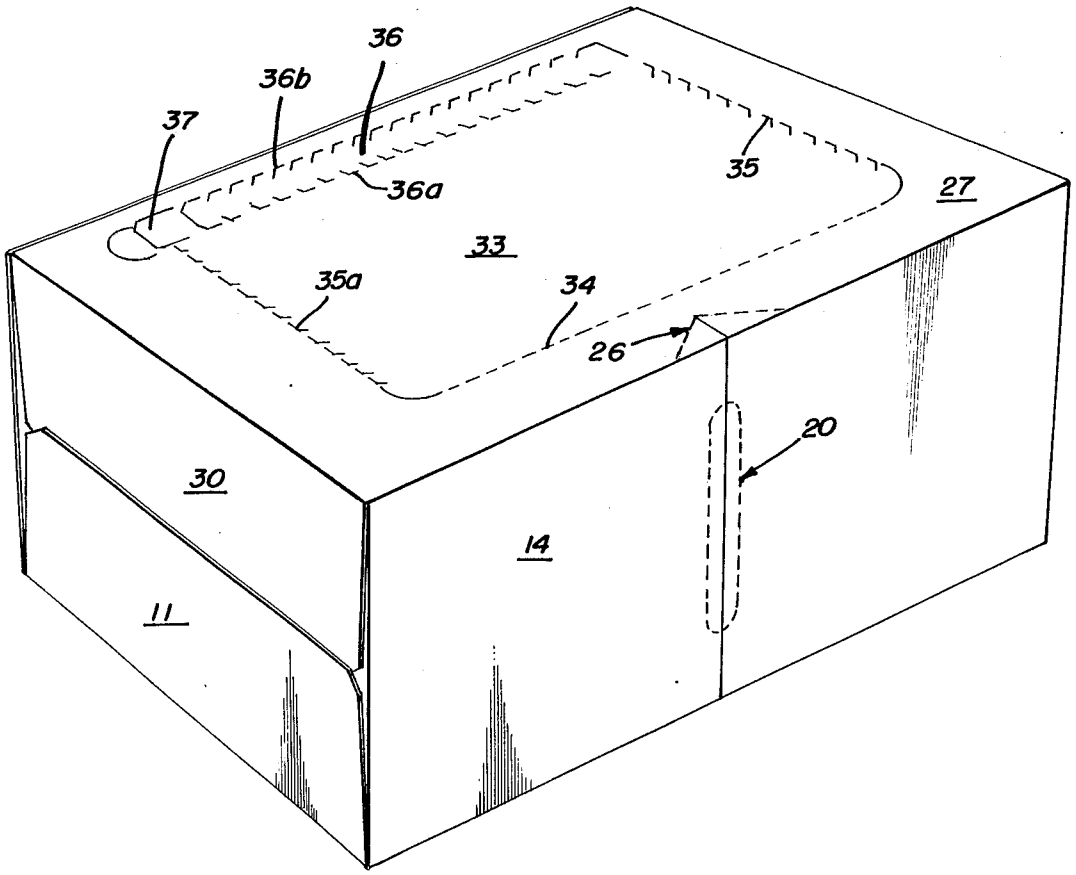
FIG. 1 is a perspective view of a carton formed according to this invention and shown in closed condition.

In order to form the carton from the blank shown in FIG. 2, an application of glue is made to wall 33 as indicated by stippling G and wall 1 is folded upwardly and toward the left so that lap panel 6 and wall 1 are disposed in flat face contacting relation with wall 8. Thereafter wall 27 is folded upwardly and toward the left along fold line 28 to cause the edge portion to which glue G has been applied to engage and adhere to the lap panel 6. Thereafter the carton is set up in tubular form and loaded through its ends and the end closure panels are appropriately glued and folded into overlapping relation in known manner as indicated for example in FIGS. 1 and 4 to complete the carton as represented in loaded condition in FIG. 1.

In order to unload the carton, it is simply necessary to engage the pull tab 37 and to remove the tear strip 36. Thereafter the edge **36*a* of the reclosable opening panel 33 is engaged and elevated so as to sever the reclosable opening panel 33 along lines 35 and 35*a* and to fold the panel 33 into the position shown for example in FIG. 4**. Of course the loaded cans "C" may then be removed and the contents used.

Figure 4:
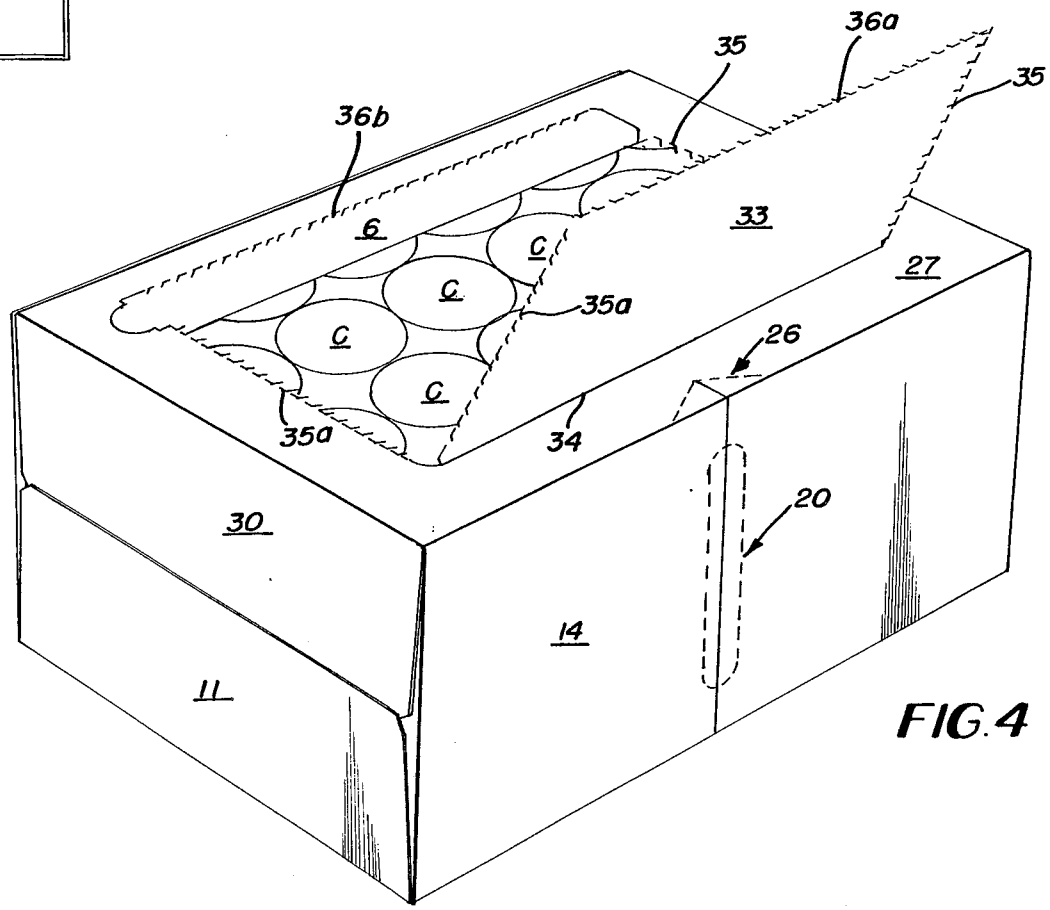
FIG. 4 is a view similar to FIG. 1 but which shows the carton in opened condition.
Figure 3:
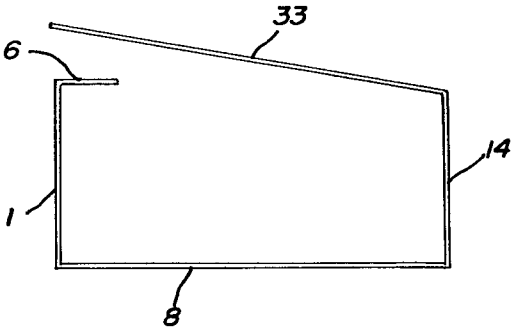
FIG. 3 is an overall schematic representation which indicates in a general way the principal constructional features of a carton formed according to this invention.
Figure 6:
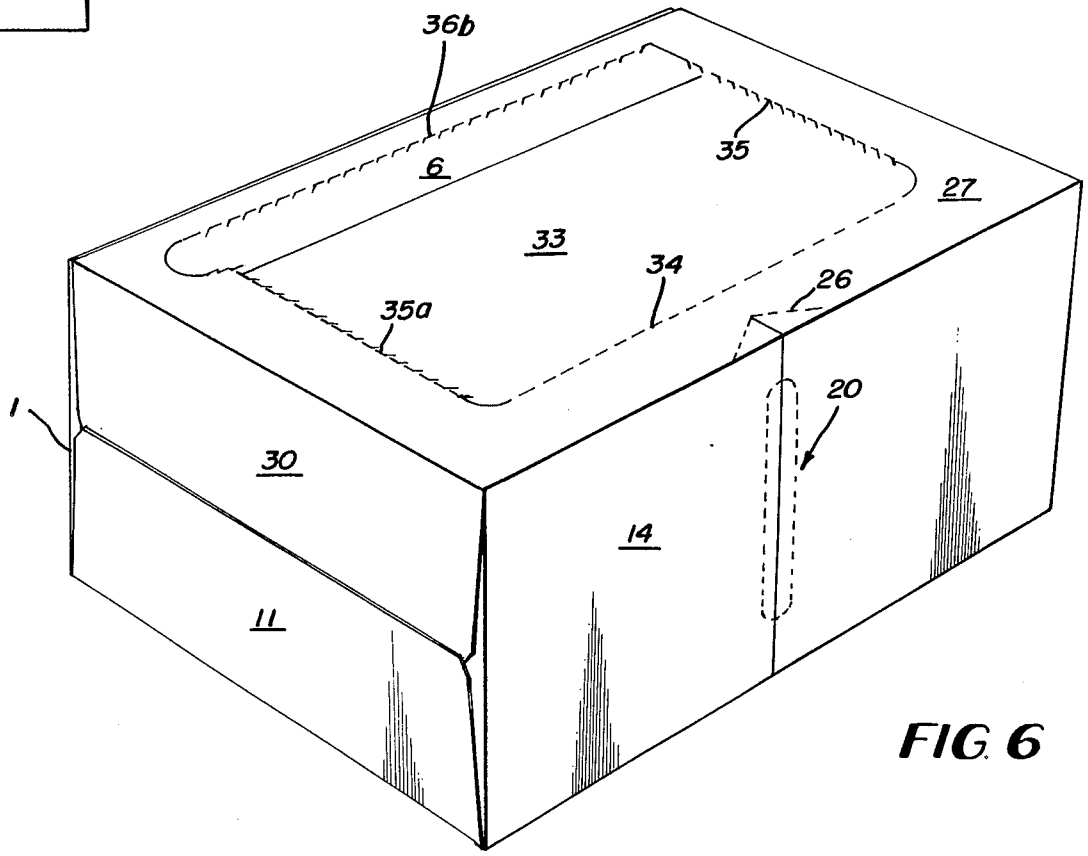
FIG. 6 is a view similar to FIG. 4 and shows the carton in reclosed condition.
Figure 5:
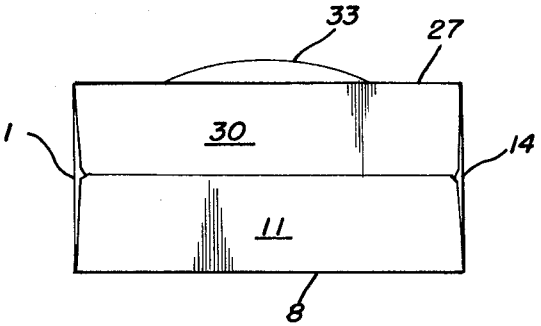
FIG. 5 is an end view of the carton while the reclosable opening panel is in the process of being inserted into closed condition or during an intermediate opening stage.

After the contents of the cans C are utilized, the cans may be reloaded into the carton as shown in FIG. 4. Thereafter in order to reclose the carton, the reclosable opening panel 33 is swung generally toward the left from the position shown in FIG. 4 and the edge portion adjacent tear line **36*a* is tucked under the lap panel 6 and into flat face contacting relation with the inner surface of lap panel 6. Thereafter the carton is in reclosed condition as shown in FIG. 6**.

For some applications of the invention, it may be desirable to dispense with the tear strip 36 and its associated pull tab 37. In order to eliminate the tear strip 36 and its pull tab 37, the structure shown in FIGS. 7, 8 and 9 may be employed if desired.

Figure 8:
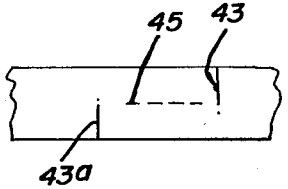
FIG. 8 is an enlarged fragmentary cross sectional view taken along the line designated 8—8 in FIG. 7.
Figure 7:
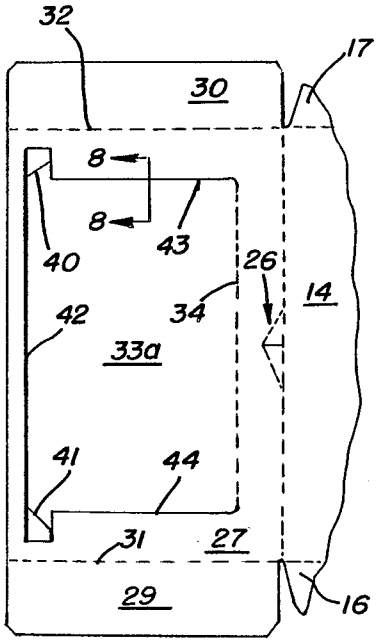
FIG. 7 is a fragmentary view of the right hand end portion of FIG. 2 as viewed from the outside and which discloses a modification of the reclosure structure formed according to this invention.

With reference to FIG. 7, the pull tabs 40 and 41 may be formed integrally with the corners of reclosable be substituted for the pull tabs and for the tear lines 37 and 35*a* as best shown in FIG. 2. The cut scoring lines 42, 43 and 44 as shown in the enlarged fragmentary cross section identified as FIG. 8 show the cut scoring line 43 which is formed in the outer surface of FIG. 7 is displaced from the reverse cut scoring line 43*a* which is formed in the inside surface of panel 27. Thus when the reclosable opening panel 33*a* is opened, the structure of wall 27 is caused to separate along the medial line designated 45 in FIG. 8. Of course cut scoring and reverse cut scoring are well known in the art but their application to the particular type of reclosable carton to which this invention pertains is believed novel. Of course the reclosable opening panel 33*a* is opened simply by engaging either one or both of the pull tabs 40 and 41 and by elevating those tabs away from panel 27. The carrier of course at that time is then in open condition as represented in FIG. 4.

Figure 9:
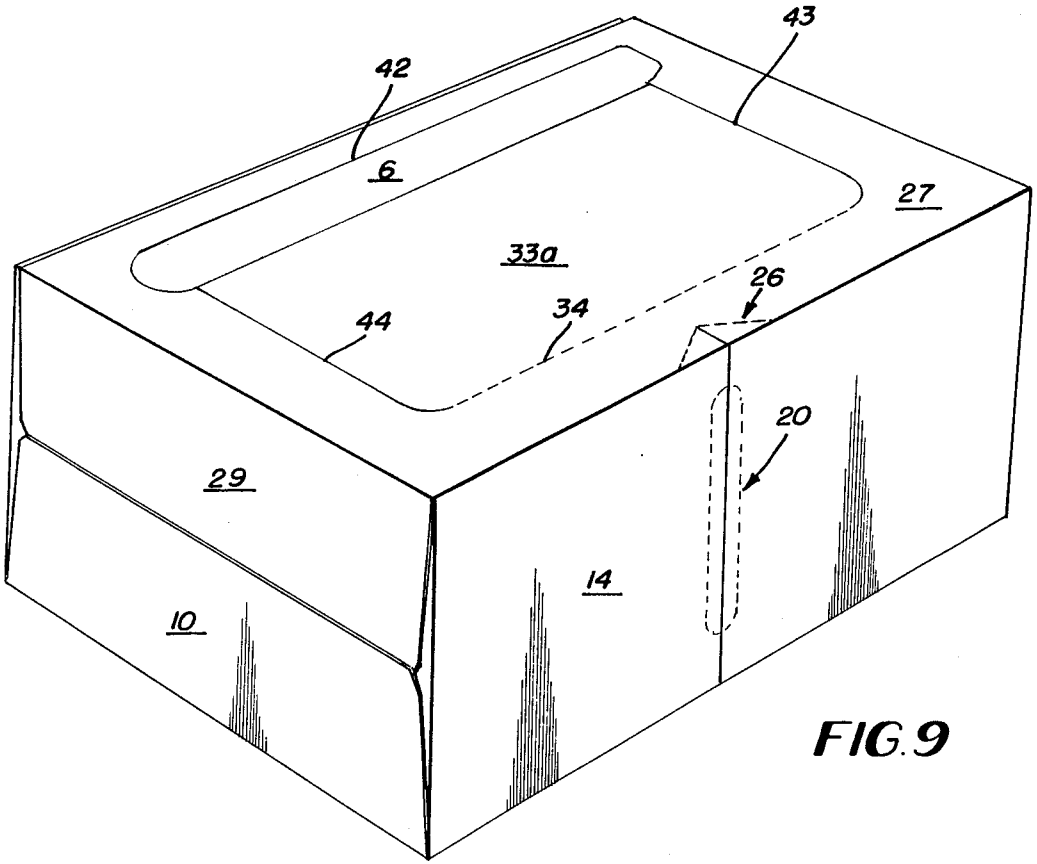
FIG. 9 is a view similar to FIG. 6 and shows reclosed condition of FIGS. 7 and 8.

In order to reclose the structure of FIGS. 7, 8 and 9, the edge portion of reclosable opening panel 33*a* defined by cut line 42 is simply tucked underneath the lap panel 6 and the carton then appears as shown in FIG. 9.

It should be observed that the so-called slot handle as designated by the numeral 20 is formed in a wall panel remote from the lap panel 6. As is well known, the lap panel 6 constitutes a part of a manufacturer's glue joint. If the carton were formed with a double ply thickness in the wall such as 14 in which the handle is formed, the lap panel 6 would necessarily be in the area generally identified by the structure 25 or 26 and there would be a tendency for the overlapping panels including the lap panel to buckle. By this invention, this problem is eliminated.

I claim:

1. A reclosable carton for packaging a plurality of cans and having interconnected top, bottom and side walls and end closure panels, a reclosable opening panel struck from one of said walls and foldably joined thereto along one part of its periphery and severable therefrom along other parts thereof, a lap panel disposed in flat face contacting relation with a part of the inner surface of said one wall and in overlapping relation with an edge of said reclosable opening panel along which said reclosable opening panel is severable from said one wall, and an edge of said reclosable opening panel being arranged to be tucked into engagement with the inner surface of said lap panel so as to reclose the carton.

2. A reclosable carton according to claim 1 wherein said reclosable opening panel is of generally rectangular configuration and is foldably joined to said one wall along a generally straight fold line defining one edge of said reclosable opening panel.

3. A reclosable carton according to claim 2 wherein said reclosable opening panel is severable from said one wall along the three other edges of said reclosable opening panel.

4. A reclosable carton according to claim 1 wherein said lap panel constitutes a manufacturer's glue joint whereby said one carton wall is foldably joined to the adjacent carton wall.

5. A reclosable carton according to claim 1 wherein said reclosable opening panel is severable from said one wall along an edge thereof remote from said one part of its periphery by a removable tear strip.

6. A reclosable carton according to claim 5 wherein a manually engageable pull tab is formed integrally with said tear strip at least one end thereof.

7. A reclosable carton according to claim 3 wherein said reclosable opening panel is severable from said one wall along said three other edges at scoring lines from one surface thereof and by reverse cut scoring lines from the opposite surface thereof.

8. A reclosable carton according to claim 7 wherein said cut scoring lines are offset by approximately three sixteenths inch from said reverse cut scoring lines.

9. A reclosable carton according to claim 7 wherein a pull tab is formed integrally with said reclosable opening panel at a corner thereof remote from said one edge thereof.

10. A reclosable carton according to claim 2 wherein a carrying handle is formed in a carton wall adjacent to said generally straight fold line.

11. A reclosable carton according to claim 4 wherein a single ply handle is disposed in one of said side walls.

* * * * *